US011072456B2

(12) United States Patent
Zacherle

(10) Patent No.: US 11,072,456 B2
(45) Date of Patent: Jul. 27, 2021

(54) CARTON AND CARTON BLANK

(71) Applicant: WestRock Packaging Systems, LLC, Atlanta, GA (US)

(72) Inventor: Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 16/335,155

(22) PCT Filed: Sep. 28, 2017

(86) PCT No.: PCT/US2017/053993

§ 371 (c)(1),
(2) Date: Mar. 20, 2019

(87) PCT Pub. No.: WO2018/064321

PCT Pub. Date: Apr. 5, 2018

(65) Prior Publication Data

US 2019/0276180 A1 Sep. 12, 2019

Related U.S. Application Data

(60) Provisional application No. 62/402,156, filed on Sep. 30, 2016.

(51) Int. Cl.

| | |
|---|---|
| ***B65D 5/468*** | (2006.01) |
| ***B65D 5/02*** | (2006.01) |
| ***B65D 5/44*** | (2006.01) |

(52) U.S. Cl.

CPC ..... *B65D 5/4608* (2013.01); *B65D 5/0227* (2013.01); *B65D 5/443* (2013.01); *B65D 2525/28* (2013.01); *B65D 2571/00524* (2013.01)

(58) Field of Classification Search

CPC .... B65D 5/4608; B65D 5/0227; B65D 5/443; B65D 2571/00524; B65D 2571/0045; B65D 2571/00518; B65D 5/06

(Continued)

(56) References Cited

U.S. PATENT DOCUMENTS 2,703,197 A * 3/1955 Brasch ..... B65D 5/4608 229/117.17

3,989,181 A 11/1976 Wilcox (Continued)

FOREIGN PATENT DOCUMENTS

CA 644715 A 10/1962
WO WO2007022482 A1 2/2007

*Primary Examiner* — Christopher R Demeree
(74) *Attorney, Agent, or Firm* — Brian J. Goldberg; Neil G. Cohen

(57) ABSTRACT

Aspects of the disclosure relate to a carton (90) for packaging one or more articles (B). The carton (90) comprises a plurality of panels (12, 14, 16, 18) for forming a tubular structure. The plurality of panels comprises: a first side wall panel (12); a first end wall panel (14); a second side wall panel (16); and a second end wall panel (18). A first handle structure (H) is defined in a first one of the plurality of panels (12). The first handle structure (H) comprises a severance line (60) defining at least in part a handle opening. A first end closure panel (22*b*) forms, at least in part, a top wall (22*b*/24*b*/26*b*/28*b*) which at least partially closes an upper end of the tubular structure and is hingedly connected to the first one of the plurality of panels (12) by a first hinged connection (23*b*).

16 Claims, 7 Drawing Sheets

FIGURE 1A

(58) Field of Classification Search
USPC ..... 229/117.13, 117.16, 117.17; 206/427
See application file for complete search history.

(56) References Cited

U.S. PATENT DOCUMENTS

| | | | | |
|---|---|---|---|---|
| 4,037,777 | A | 7/1977 | Maughan | |
| 4,967,901 | A | 11/1990 | Wood | |
| 7,870,993 | B2 | 1/2011 | Walling | |
| 2006/0261138 | A1 | 11/2006 | Bates | |
| 2009/0212095 | A1* | 8/2009 | Auclair | B65D 5/324 229/100 |
| 2017/0313469 | A1* | 11/2017 | Hayslette | B65D 5/18 |
| 2017/0327266 | A1* | 11/2017 | Zacherle | B65D 71/0022 |
| 2018/0118405 | A1 | 5/2018 | Walling | |

* cited by examiner

CARTON AND CARTON BLANK

TECHNICAL FIELD

The present invention relates to a carton and blank for forming the same and more specifically, but not exclusively, to a carton comprising at least one reinforced handle structure.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

It is desirable to provide a carton comprising a handle structure for forming a carrying handle to transport the carton. The carrying handle must be sufficiently robust and strong to withstand the load of the carton contents.

The present invention seeks to overcome or at least mitigate the problems of the prior art.

SUMMARY

A first aspect of the invention provides a carton for packaging one or more articles, the carton comprising: a first panel; and a second panel hingedly connected by a first hinged connection to the first panel; the first panel comprising a handle structure, the handle structure comprising a severance line defining at least in part a handle opening; the second panel having a handle reinforcing panel hingedly connected to the second panel by two further hinged connections; wherein the two further hinged connections are spaced from the first hinged connection.

Optionally, the handle reinforcing panel comprises a cutaway shaped in a complementary manner to at least a portion of the handle opening and the remainder of the handle reinforcing panel is shaped similarly to an upper portion of the first panel to reinforce an area of the first panel either side of and above the handle structure in the first panel.

Optionally, the two further hinged connections are spaced apart from the first hinged connection and are parallel to the first hinged connection.

Optionally, the two further hinged connections each extend into the second panel by a distance of between 10% and 20% of the maximum width of that second panel such that the two hinged connections are spaced apart from each other and from the first hinged connection.

Optionally, the second panel forms a minor end closure panel.

Optionally, the handle structure comprises a handle flap defining at least in part the handle opening.

Optionally, the handle reinforcing panel comprises a cushioning flap arrangement which co-operates with said handle flap.

Optionally, the handle reinforcing panel is hingedly connected to the second panel via a pair of connecting panels.

Optionally, the pair of connecting panels are not secured to the second panel and the handle reinforcing panel is secured to the first panel.

Optionally, the connecting panels of said pair of connecting panels are each formed from material that would otherwise form part of the second panel and wherein the connecting panels are hingedly connected to the second panel by said two further hinged connections.

Optionally, the first panel forms a side wall panel or wherein the first panel forms an end wall panel.

A second aspect of the invention provides a blank for forming a carton, the blank comprising: a first panel; a second panel hingedly connected by a first hinged connection to the first panel; the first panel comprising a handle structure, the handle structure comprising a severance line defining at least in part a handle opening; and a handle reinforcing panel hingedly connected to the second panel by a first pair of connecting panels which first pair of connecting panels is hingedly connected to the second panel by two further hinged connections, wherein the two further hinged connections are spaced from the first hinged connection.

Optionally, the handle reinforcing panel comprises a cutaway shaped in a complementary manner to at least a portion of the handle opening and the remainder of the handle reinforcing panel is shaped similarly to an upper portion of the first panel for providing a reinforcement of an area of the first panel either side of and above the handle structure in the first panel.

Optionally, the two further hinged connections are spaced apart from the first hinged connection; are parallel to the first hinged connection; and are spaced apart from one another.

A third aspect of the invention provides a carton for packaging one or more articles, the carton comprising: a plurality of panels for forming a tubular structure, the plurality of panels comprising: a first side wall panel; a first end wall panel; a second side wall panel; and a second end wall panel, a first handle structure defined in a first one of the plurality of panels, the first handle structure comprising a severance line defining at least in part a handle opening; a first end closure panel forming, at least in part, a top wall which at least partially closes an upper end of the tubular structure and is hingedly connected to the first one of the plurality of panels by a first hinged connection; a first handle reinforcing panel hingedly connected to the first end closure panel by a pair of connecting panels hinged to the first end closure panel by two further hinged connections; wherein the two further hinged connections are spaced from the first hinged connection.

Optionally, the handle reinforcing panel comprises a cutaway shaped in a complementary manner to at least a portion of the handle opening and the remainder of the handle reinforcing panel is shaped similarly to an upper portion of the first one of the plurality of panels to reinforce an area of the first one of the plurality of panels either side of and above the handle structure in the first panel.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EXEMPLARY EMBODIMENTS

Detailed descriptions of specific embodiments of the packages, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figures 1, 1A:
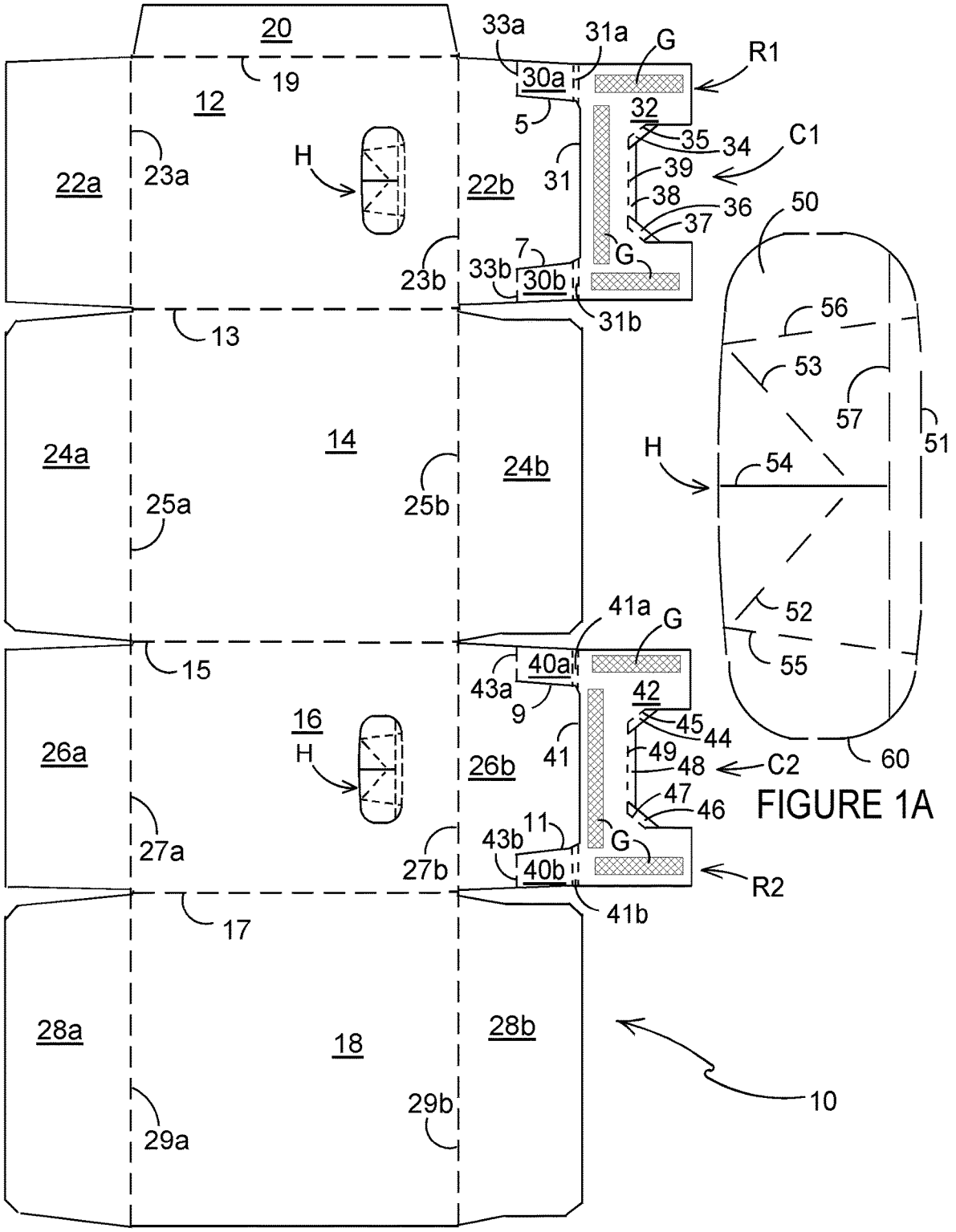
FIG. 1 is a plan view from above of a blank for forming a carton according to an embodiment of the invention.
FIG. 1A illustrates an enlarged view of a handle structure H for use with the blank of FIG. 1.
Figure 2:
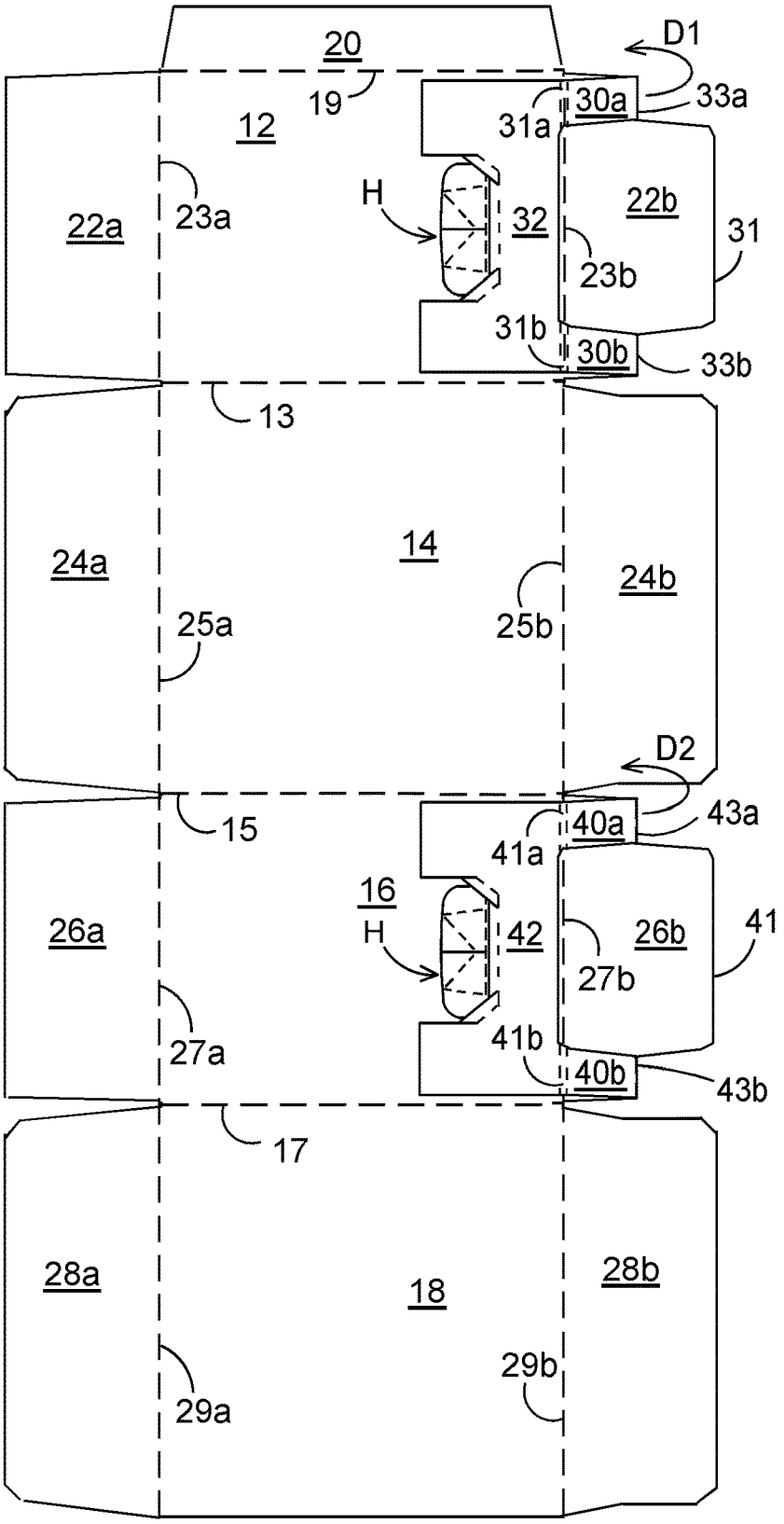
FIGS. 2 to 6 illustrate stages of construction of a carton from the blank of FIG. 1.
Figure 3:
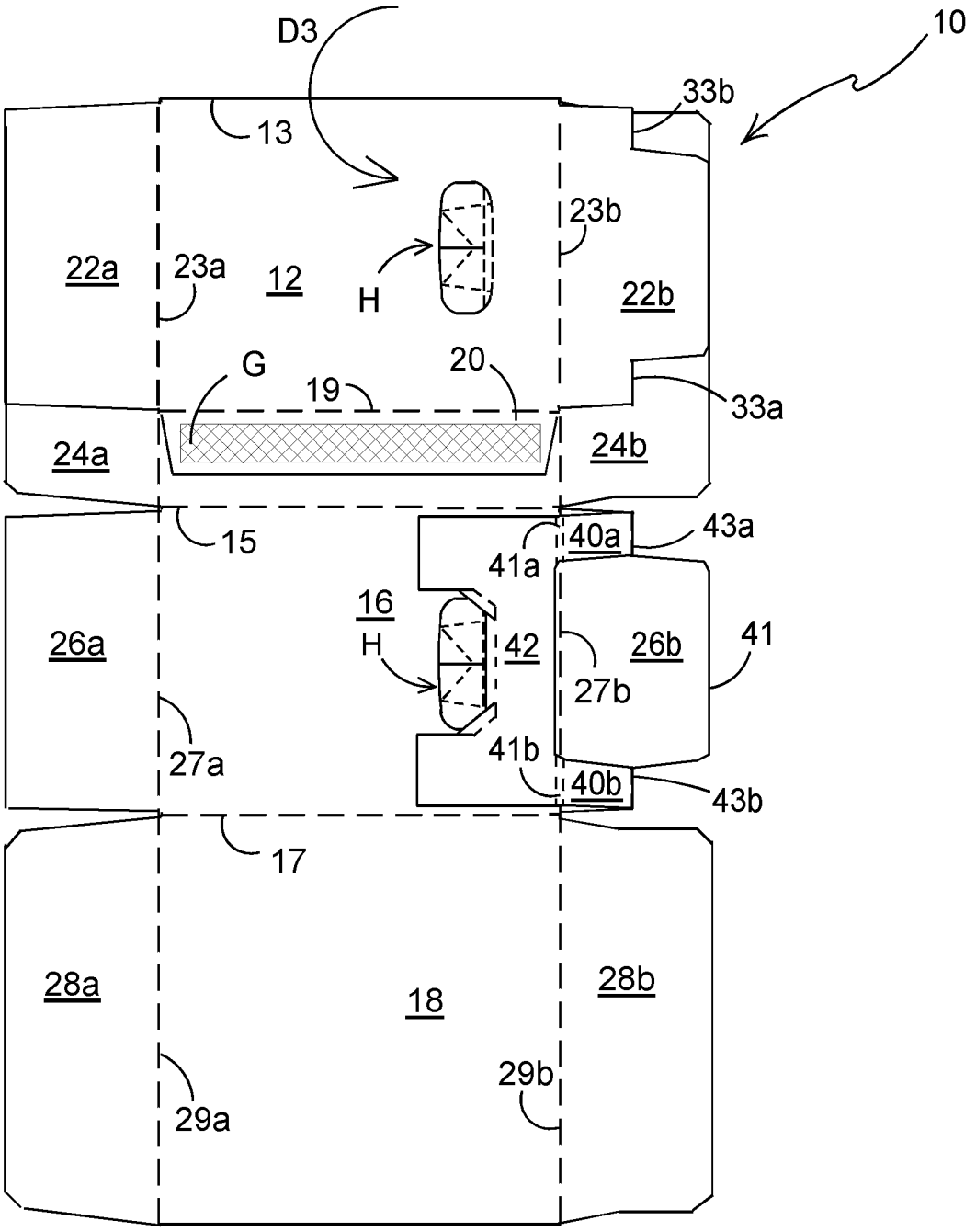
Figure 4:
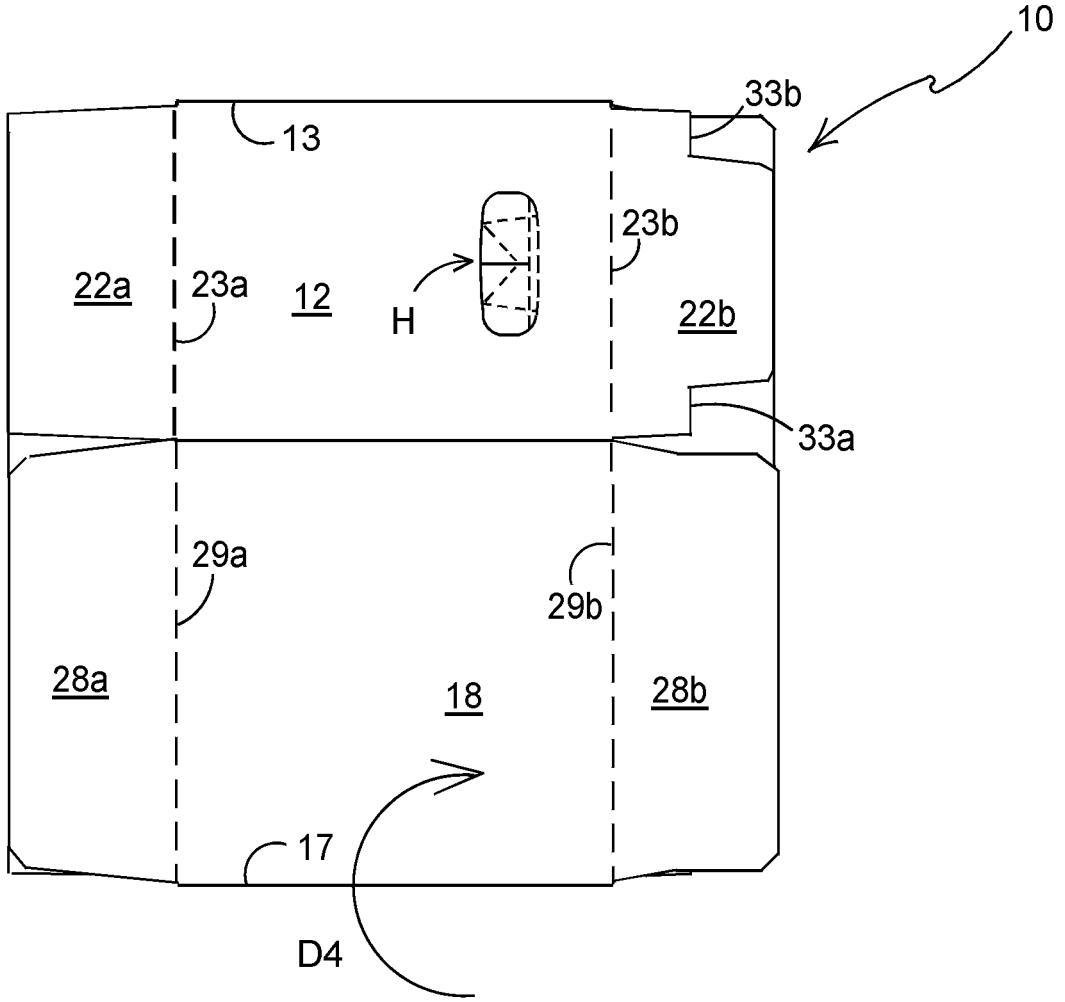

Referring to FIGS. 1 and 1A there is shown a blank 10 for forming a carton 90 capable of accepting an input of primary products such as, but not limited to, bottles or cans, hereinafter referred to as articles B. In one application, the articles are glass bottles, each containing 12 oz (340 ml) of beverage, and twelve such bottles are to be loaded into the carton 90. Optionally, the carton is top loaded and the carton is a crate style carton. Optionally, the carton is capable of supporting a large weight of about 6.5 kg to about 7.5 kg in total weight. To lift such a weight a strong and robust carrying handle is provided. It is convenient to position the carrying handles opposite one another and near to the top of the carton to form a crate style carton.

Referring again to FIG. 1, the blank 10 comprises a plurality of main panels 20, 12, 14, 16, 18 hinged one to the next in a linear series. A glue panel 20 is hinged by a hinged connection such as a fold line 19 to a first side wall panel 12. The first side wall panel 12 is hinged to a first end wall panel 14 by a hinged connection such as a fold line 13. The first end wall panel 14 is hinged to a second side wall panel 16 by a hinged connection such as a fold line 15. The second side wall panel 16 is hinged to a second end wall panel 18 by a hinged connection such as a fold line 17.

The plurality of main panels 12, 14, 16, 18, 20 of the blank 10 form walls of an open-ended tubular structure in a set up condition. The tubular structure is at least partially closed by end closure structures. The tubular structure has a tubular axis defining a longitudinal direction.

Each of the ends of the tubular structure is at least partially closed by end closure panels which form end walls (or top and bottom walls) of the tubular structure. In the illustrated embodiment the ends of the tubular structure are fully closed by end closure panels 22*a*, 24*a*, 26*a*, 28*a*; and 22*b*, 24*b* 26*b*, 28*b* respectively.

End closure panels 22*a*, 24*a*, 26*a*, 28*a* are configured to close a first end of the tubular structure and form a composite base panel of a carton 90. End closure panels 22*b*, 24*b*, 26*b*, 28*b* are configured to close a second end of the tubular structure and form a composite top panel of the carton 90.

The first end (bottom) of the tubular structure is closed by a first end closure panel 22*a*, a second end closure panel 24*a*, a third end closure panel 26*a* and a fourth end closure panel 28*a*. The first end closure panel 22*a* is hinged to a first end of the first side wall panel 12 by a hinged connection such as a fold line 23*a*. The second end closure panel 24*a* is hinged to a first end of the first end wall panel 14 by a hinged connection such as a fold line 25*a*. The third end closure panel 26*a* is hinged to a first end of the second side wall panel 16 by a hinged connection such as a fold line 27*a*. The fourth end closure panel 28*a* is hinged to a first end of the second end wall panel 18 by a hinged connection such as a fold line 29*a*.

The second end of the tubular structure is closed by a fifth end closure panel 22*b*, a sixth end closure panel 24*b*, a seventh end closure panel 26*b* and an eighth end closure panel 28*b*. The fifth end closure panel 22*b* is hinged to a second end of the first side wall panel 12 by a hinged connection such as a fold line 23*b*. The sixth end closure panel 24*b* is hinged to a second end of the first end wall panel 14 by a hinged connection such as a fold line 25*b*.

The seventh end closure panel 26*b* is hinged to a second end of the second side wall panel 16 by a hinged connection such as a fold line 27*b*. The eighth end closure panel 28*b* is hinged to a second end of the second end wall panel 18 by a hinged connection such as a fold line 29*b*.

The first, third, fifth and seventh end closure panels 22*a*, 26*a*, 22*b*, 26*b* form minor end closure panels (also referred to as dust flaps). The first, third, fifth and seventh end closure panels 22*a*, 26*a*, 22*b*, 26*b* may be disposed innermost.

The second, fourth, sixth and eighth end closure panels 24*a*, 28*a*, 24*b*, 28*b* form major end closure panels. The second, fourth, sixth and eighth end closure panels 24*a*, 28*a*, 24*b*, 28*b* may be disposed outermost.

The blank 10 comprises at least one handle structure H for forming a carrying handle H. The illustrated embodiment shows a first handle structure H formed in the first side wall panel 12 and a second handle structure H formed in the second side wall panel 16. In alternative embodiments, a handle structure may be provided in either of the first and/or second end wall panels 14, 18. In still other embodiments a handle structure may be provided in each of the side and end wall panels 12, 14, 16, 18. The provision of two handle structures disposed opposite to one another provides for a crate-style carton that is lifted close to the top of the carton.

The first and second handle structures H are substantially the same in construction and will be described in further detail by reference to FIG. 1A which illustrates an enlarged view of a handle structure H.

Each handle structure H optionally has the same configuration and comprises a flap 50 defined by a severance line 60 and a hinged connection in the form of a first fold line 51. The flap 50 defines an opening (not shown) in a panel forming the carton 90 into which opening a user may insert at least a portion of their hand.

The flap 50 in the undeployed state optionally acts as a dust cover preventing ingress of dirt into the carton 90. In the deployed state the flap 50 acts as a cushioning flap so as to make a comfortable carrying handle. This is particularly beneficial where the load contained in the carton 90 is heavy and there would otherwise exist a risk of a bare handle edge cutting into, or making sore, a user's hand.

The flap 50 is hinged to the panel from which it is struck (in this arrangement first side wall panel 12 or second side wall panel 16) by first fold line 51. The flap 50 may comprise an optional second fold line 57 disposed in a parallel manner to the first fold line 51. Optionally the second fold line 57 is disposed proximate the first fold line 51, and may be longer than the first fold line 51. The flap 50 may comprise an optional second severance line 54 which extends between the second fold line 57 and the severance line 60 so as to substantially bisect a portion of the flap 50.

The flap 50 may optionally comprise a third fold line 52, a fourth fold line 53, a fifth fold line 55 and a sixth fold line 56, which together are arranged in a substantially "W" shape. The third and fifth fold lines 52, 55 form a first "V" shape on a first side of the second severance line 54. The fourth and sixth fold lines 53, 56 form a second "V" shape on a second side of the second severance line 54. The fifth and sixth fold lines 55, 56 extend between the first fold line 51 and the severance line 60. The fifth and sixth fold lines 55, 56 are arranged divergently with respect to each other and diverge towards the first fold line 51. The second and third fold lines 52, 53 are arranged divergently with respect to each other and diverge towards the severance line 60.

In addition to the handle structures H, the blank 10 comprises a first handle reinforcing structure R1 and a second handle reinforcing structure R2. In this arrangement a reinforcing structure R1, R2 is provided for each of the handle structures H formed in the first side wall panel 12 and second side wall panel 16. In other arrangements where a handle structure may be provided in each of the side and end wall panels 12, 14, 16, 18, other numbers of reinforcing structure may be provided.

The first handle reinforcing structure R1 comprises a first pair of connecting panels 30*a*, 30*b* and a first reinforcing panel 32. The connecting panels 30*a*, 30*b* of the first pair of connecting panels 30*a*, 30*b* are spaced apart and are each hinged to the fifth end closure panel 22*b* by a hinged connection in the form of a fold line 33*a*, 33*b*. Fold line 33*a* extends from a first edge of the fifth end closure panel 22*b*, about half-way along that first edge, into the fifth end closure panel 22*b*. The fold line 33*a* may extend into the fifth end closure panel 22*b* by a distance equal to between about 10% and about 20% of the maximum width of that fifth end closure panel 22*b*. Further optionally, the fold line 33*a* may extend into the fifth end closure panel 22*b* by a distance equal to about 14% of the maximum width of that fifth end closure panel 22*b*.

Similarly, fold line 33*b* extends from a second edge of the fifth end closure panel 22*b*, about half-way along that second edge, into the fifth end closure panel 22*b*. The fold line 33*b* may extend into the fifth end closure panel 22*b* by a distance equal to between about 10% and about 20% of the maximum width of that fifth end closure panel 22*b*. Further optionally, the fold line 33*a* may extend into the fifth end closure panel 22*b* by a distance equal to about 14% of the maximum width of that fifth end closure panel 22*b*. The fold lines 33*a*, 33*b* are in line with one another and are similarly sized. The connecting panels 30*a*, 30*b* are each further defined, at least in part, by a first severance or cut line 5 and a second severance or cut line 7 respectively.

The connecting panels 30*a*, 30*b* are each hinged to the first reinforcing panel 32 by a hinged connection in the form of a double crease fold line arrangement 31*a*, 31*b*. The hinged connections 31*a*, 31*b* are structured and arranged, such that when the first handle reinforcing structure R1 is formed, a crease line of each double crease line arrangement of hinge connection 31*a*, 31*b* is disposed just either side of fold line 23*b* (between the first side wall panel 12 and the fifth end closure panel 22*b*.

Accordingly, the connecting panels 30*a*, 30*b* are struck, at least in part, from the fifth end closure panel 22*b*. The first reinforcing panel 32 is hinged to the fifth end closure panel 22*b* by virtue of the hinged connections 31*a*, 31*b* and is otherwise separated therefrom by cut or severance line 31. Severance line 31 extends between the hinged connection 31*a* and hinged connection 31*b*.

The first reinforcing panel 32 comprises a cutaway C1. Cutaway C1 is shaped to be complementary to the shape of the opening defined by the flap 50. Accordingly, the first reinforcing panel 32 is substantially square "U"-shaped and has a shape complimentary to an upper portion of the first side wall panel 12.

The first reinforcing panel 32 may comprise one or more cushioning flaps 34, 36, 38. The illustrated embodiment comprises a first cushioning flap 34 hinged to first reinforcing panel 32 by a fold line 35, a second cushioning flap 36 hinged to the first reinforcing panel 32 by a fold line 37, and a third cushioning flap 38 hinged to the first reinforcing panel 32 by a fold line 39. Fold line 39 is arranged to be substantially parallel to cut line 31. Fold line 35 is arranged divergently with respect to fold line 39. Fold line 37 is arranged divergently with respect to fold line 39. Fold line 35 is convergently arranged with respect to fold line 37 and converges towards fold line 39.

The second handle reinforcing structure R2 comprises a similar structure as the first reinforcing structure R1. As can be seen in FIG. 1, the second handle reinforcing structure R2 comprises a second pair of connecting panels 40*a*, 40*b* and a second reinforcing panel 42. The connecting panels 40*a*, 40*b* of the second pair of connecting panels 40*a*, 40*b* are spaced apart and are each hinged to the seventh end closure panel 26*b* by a hinged connection in the form of a fold line 43*a*, 43*b*.

Fold line 43*a* extends from a first edge of the seventh end closure panel 26*b*, at a point about half-way along that first edge, into the seventh end closure panel 26*b*. The fold line 43*a*, may extend into the seventh end closure panel 26*b* by a distance equal to between about 10% and about 20% of the maximum width of that seventh end closure panel 26*b*. Further optionally, the fold line 43*a* may extend into the seventh end closure panel 26*b* by a distance equal to about 14% of the maximum width of that seventh end closure panel 26*b*. Similarly, fold line 43*b* extends from a second edge of the seventh end closure panel 26*b*, about half-way along that second edge, into the seventh end closure panel 26*b*. The fold line 43*b* may extend into the seventh end closure panel 26*b* by a distance equal to between about 10% and about 20% of the maximum width of that seventh end closure panel 26*b*. Further optionally, the fold line 43*a* may extend into the seventh end closure panel 26*b* by a distance equal to about 14% of the maximum width of that seventh end closure panel 26*b*. The fold lines 43*a*, 43*b* are in line with one another and are similarly sized. The connecting panels 40*a*, 40*b* are each further defined, at least in part, by a first severance or cut line 9 and a second severance or cut line 11 respectively.

The connecting panels 40*a*, 40*b* are each hinged to the second reinforcing panel 42 by a hinged connection in the form of a double crease fold line arrangement 41*a*, 41*b*. The hinged connections 41*a*, 41*b* are structured and arranged, such that when the second handle reinforcing structure R2 is formed, a crease line of each double crease line arrangement of hinge connection 41*a*, 41*b* is disposed just either side of fold line 29*b* (between the second side wall panel 16 and the seventh end closure panel 26*b*.

Accordingly, the connecting panels 40*a*, 40*b* of the second handle reinforcing structure R2 are struck, at least in part, from the seventh end closure panel 26*b*. The second reinforcing panel 42 is hinged to the seventh end closure panel 26*b* by virtue of the hinged connections 43*a*, 43*b* and is otherwise separated therefrom by cut or severance line 41. Severance line 41 extends between the hinged connection 41*a* and hinged connection 41*b*.

The second reinforcing panel 42 comprises a cutaway C1. Cutaway C1 is shaped to be complementary to the shape of the opening defined by the flap 50. Accordingly, the second reinforcing panel 42 is substantially square "U"-shaped and has a shape complimentary to an upper portion of the second side wall panel 16.

The second reinforcing panel 42 may comprise one or more cushioning flaps 44, 46, 48. The illustrated embodiment comprises a first cushioning flap 44 hinged to second reinforcing panel 42 by a fold line 45, a second cushioning flap 46 hinged to the second reinforcing panel 42 by a fold line 47, and a third cushioning flap 48 hinged to the second reinforcing panel 42 by a fold line 49. Fold line 49 is arranged to be substantially parallel to cut line 41. Fold line 45 is arranged divergently with respect to fold line 49. Fold line 47 is arranged divergently with respect to fold line 44. Fold line 45 is convergently arranged with respect to fold line 47 and converges towards fold line 49.

The carton 90 (see FIG. 7) can be formed by a series of sequential folding operations in a straight line machine so that the carton 90 may not be required to be rotated or inverted to complete its construction. The folding process is not limited to that described below and may be altered according to particular manufacturing requirements.

Turning to the construction of the carton 90 as illustrated in FIGS. 2 to 6, glue G or other adhesive treatment is applied to an inner surface of the second handle reinforcing panel 32. Alternatively, glue G or other adhesive treatment may be applied to a corresponding portion of an inner surface of the first side panel 12.

Glue G or other adhesive treatment is applied to an inner surface of the second handle reinforcing panel 42. Alternatively, glue G or other adhesive treatment may be applied to a corresponding portion of an inner surface of the second side panel 16.

Optionally, in other arrangements glue or other adhesive treatment may be applied to inner surfaces of the connecting panels 30*a*, 30, 40*a*, 40*b* or to equivalent regions of the first and second side wall panels 12, 16 respectively. Optionally and as in the present arrangement, the connecting panels 30*a*, 30*b*, 40*a*, 40*b* are not affixed by any adhesive treatment or by any other means to the first and second side wall panels 12, 16 respectively.

The blank 10 is folded (as indicated by direction arrow D1 in FIG. 2) about the fold lines 33*a* and 33*b* such that the connecting panels 30*a*, 30*b* are disposed in overlying relationship with the fifth end closure panel 22*b* and such that the first handle reinforcing panel 32 is disposed in face contacting relationship with the first side panel 12. The creases of double crease arrangement 31*a*, 31*b* are positioned above and either side of fold line 23*b*.

The connecting panels 30*a*, 30*b* are not secured to the fifth end closure panel 22*b*. The first handle reinforcing panel 32 is secured to the first side panel 12. Fold line 39 for cushioning flap 38 is disposed substantially on top of part of first fold line 51 of the handle structure H. Cushioning flap 38 is sized such that it does not overlap and stops short of the second fold line 57 of the handle structure H in the first side panel 12.

The blank 10 is folded (as indicated by direction arrow D2 in FIG. 2) about the fold lines 43*a* and 43*b*, such that the connecting panels 40*a*, 40*b* are disposed in overlying relationship with the seventh end closure panel 26*b* and such that the fourth handle reinforcing panel 42 is disposed in face contacting relationship with the second side panel 16. The creases of double crease arrangement 41*a*, 41*b* are positioned above and either side of fold line 27*b*.

The connecting panels 40*a*, 40*b* of the second handle reinforcing structure R2 are not secured to the seventh end closure panel 26*b*. The second handle reinforcing panel 42 is secured to the second side panel 16. Fold line 49 for cushioning flap 48 is disposed substantially on top of at least part of first fold line 51 of the handle structure H. Cushioning flap 48 is sized such that it does not overlap i.e. it stops short of the second fold line 57 of the handle structure H in the second side panel 16.

The blank 10 is then folded about the fold line 13 (as indicated by direction arrow D3 in FIG. 3) such that the first side panel 12 is disposed in overlying relationship with the first end panel 14, and such that the glue panel 20 is disposed in overlying relationship with the first end panel 14.

Glue G or other adhesive treatment is applied to an outer surface of the glue panel 20. Alternatively, glue G or other adhesive treatment may be applied to a corresponding edge portion of an inner surface of the second end panel 18.

The blank 10 is then folded about the fold line 17 (as indicated by direction arrow D4 in FIG. 4) such that the second end panel 18 is disposed in overlying relationship with the second side panel 16 and the glue panel 20. In this way, the second end panel 18 is secured to the glue panel 20.

The blank 10 is thus formed into a flat collapsed tubular structure which can be readily shipped or distributed to a convertor plant, at which the flat collapsed tubular structure may be erected into an open ended tubular structure and loaded with articles B.

The flat collapsed tubular structure may be erected to form an open-ended tubular structure by unfolding the first side panel 12 with respect to the first end panel 14 such that the first side panel 12 is disposed substantially perpendicularly with respect to the first end panel 14.

The carton 90, in its open ended tubular form, may be loaded with articles B through either or both open ends thereof.

It will be appreciated that in some embodiments one of the open ends of the carton 90 may be closed before loading the interior with articles B through the remaining open end.

The flat collapsed tubular structure may be closed at a first end by the first end closure panel 22*a*, second end closure panel 24*a*, third end closure panel 26*a* and fourth end closure panel 28*a* and orientated such that the first end closure panel 22*a*, second end closure panel 24*a*, third end closure panel 26*a* and fourth end closure panel 28*a* form a composite base panel. The upper end of the carton 90 remains open such that articles B can be top-loaded therethrough as shown in FIG. 6.

Once the carton 90 has been loaded with articles B the open ends of the carton 90 are closed.

The method for closing each of the open ends of the carton 90 is substantially the same and will be described by reference to closing the second open end shown in FIG. 5.

Figure 6:
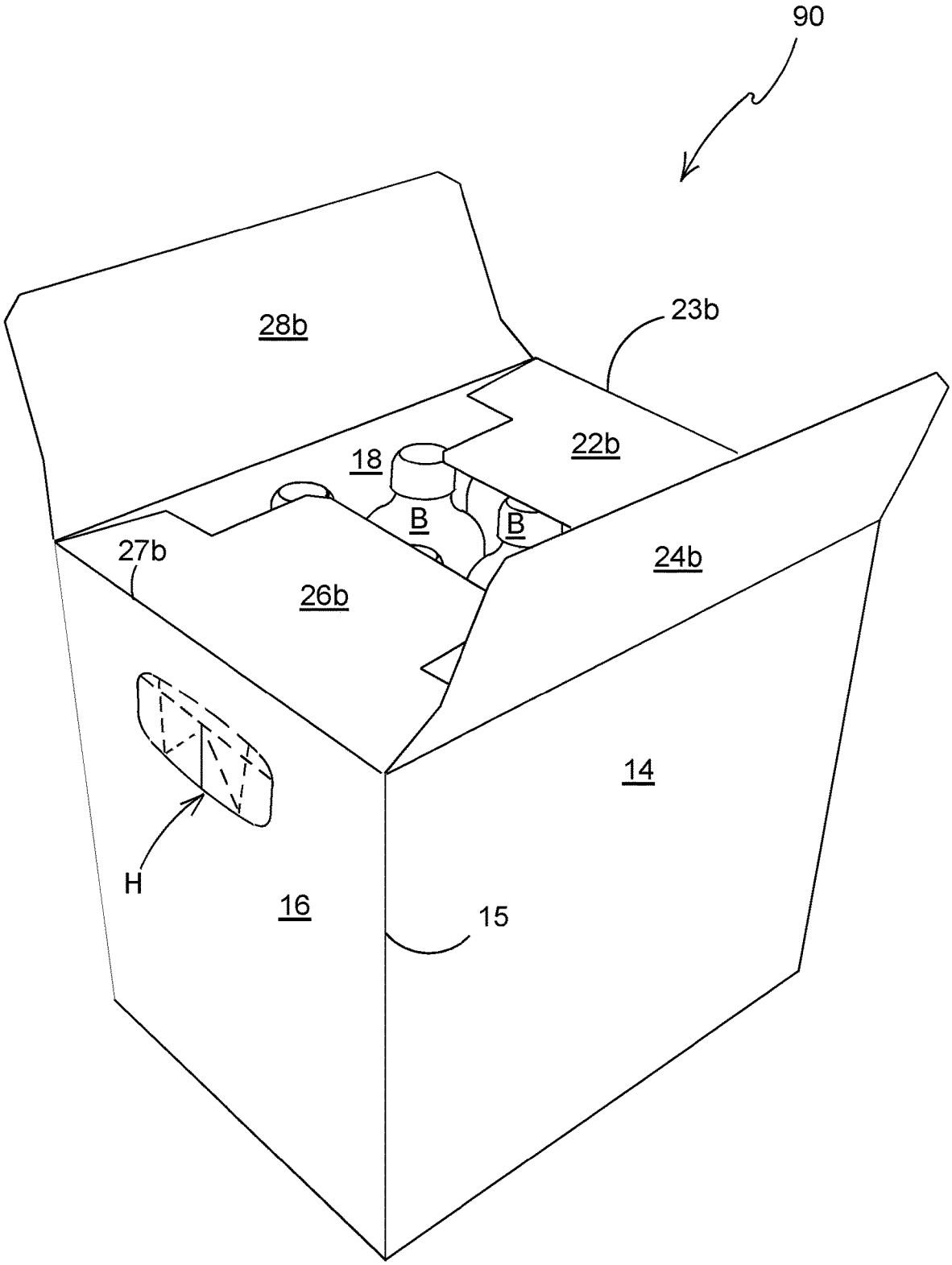

The second end of the tubular structure is closed by folding the fifth end closure panel 22*b* about fold line 23*b* and by folding the seventh end closure panel 26*b* about fold line 27*b* as shown in FIG. 6. The provision of the double crease arrangements 31*a*, 31*b*, 41*a*, 41*b* allows the fifth and seventh end closure panels 22*b*, 26*b* to fold and close in a manner unfettered by the presence of the reinforcing structures R1, R2.

Glue or other adhesive treatment may be applied to appropriate areas of an outer surface of the fifth end closure panel 22*b* and the seventh end closure panel 26*b*. In alternative embodiments glue or other adhesive treatment may be applied to a corresponding portion of an inner surface of sixth end closure panel 24*b*.

The sixth end closure panel 24*b* is then folded about the fold line 25*b* to be brought into contact with each of the fifth and seventh end closure panels 22*b*, 26*b*. The sixth end closure panel 24*b* is secured to each of the fifth and seventh end closure panels 22*b*, 26*b*.

Glue or other adhesive treatment may be applied to appropriate areas of an outer surface of the fifth end closure panel 22*b* and the seventh end closure panel 26*b*. In alternative embodiments glue or other adhesive treatment may be applied to a corresponding portion of an inner surface of the eighth end closure panel 28*b*.

The eighth end closure panel 28*b* is then folded about the fold line 29*b* to be brought into contact with each of the fifth and seventh end closure panels 22*b*, 26*b*. The eighth end closure panel 28*b* is secured to each of the fifth and seventh end closure panels 22*b*, 26*b*.

In alternative embodiments the eighth end closure panel 28*b* may be folded about fold line 29*b* before, or simultaneously with, folding the sixth end closure panel 24*b* about fold line 25*b*.

In other embodiments alternative securing means may be employed to secure the end closure panels 22*a*, 24*a*, 26*a*, 28*a*, 22*b*, 24*b*, 26*b*, 28*b* for example, but not limited to, mechanical locking devices such as staples or punch locks integrally formed within the end closure panels 22*a*, 24*a*, 26*a*, 28*a*; 22*b*, 24*b*, 26*b*, 28*b*.

Figure 7:
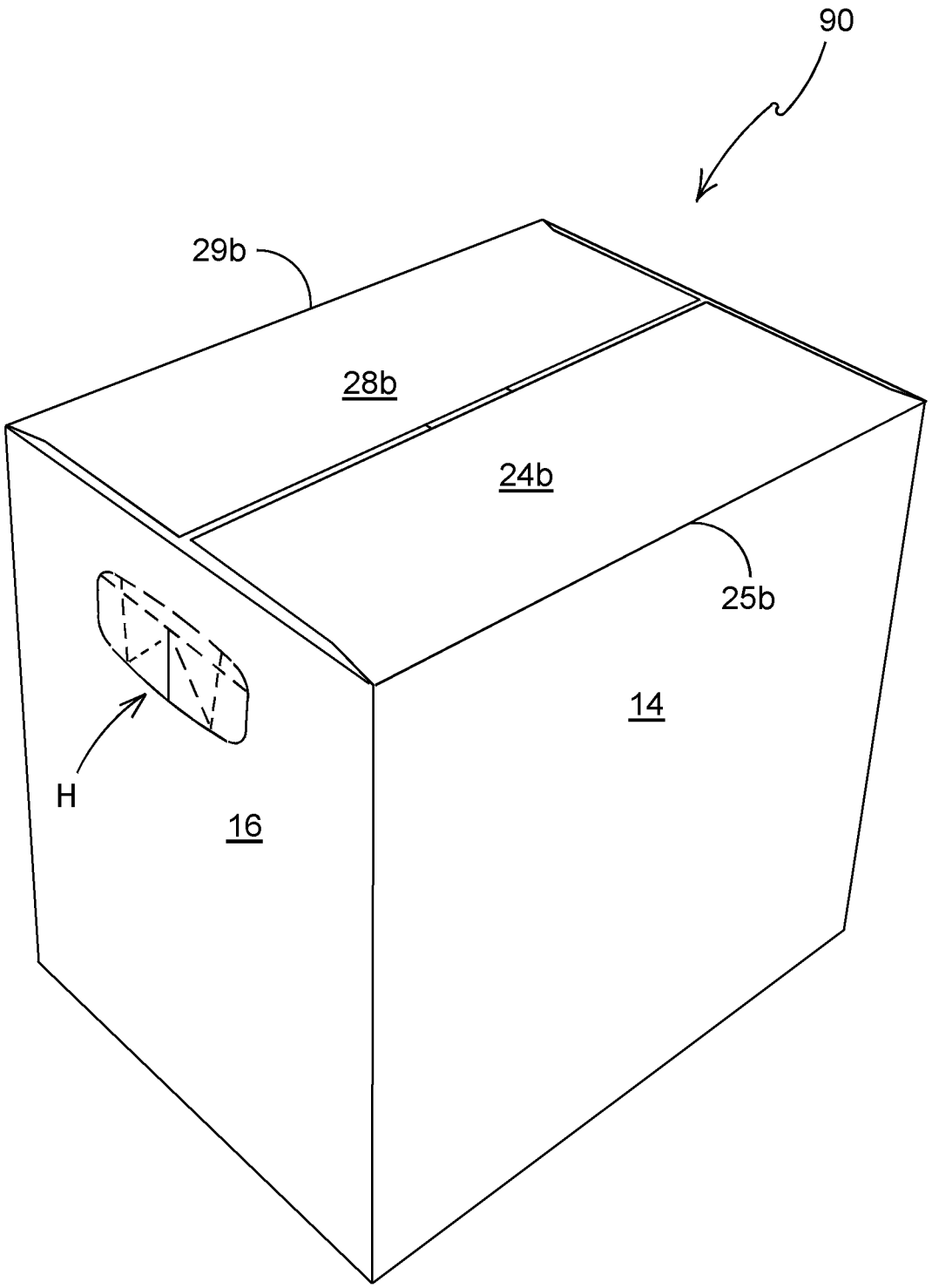
FIG. 7 is a perspective view from above of a carton formed from the blank of FIG. 1.

FIG. 7 illustrates the assembled carton 90 forming a package with a plurality of articles B.

The handle structure H in the first side wall panel 12 is substantially the same as the handle structure H in the second side wall panel 16 and the reinforcing structure associated with the fifth end closure panel 22*b* is substantially the same as the reinforcing structure associated with the seventh end closure panel 26*b*. Therefore, the carrying handle will be described in more detail by reference to the handle structure H in the first side wall panel 12 and the reinforcing structure associated with the fifth end closure panel 22*b*.

As can be seen in FIG. 7, once the package is complete, a user can break the severance line 60 and push the flap 50 internally of the carton 90. The flap 50 can fold about the third, fourth, fifth and sixth fold lines 52, 53, 55, 56. The second severance line 54 can break, substantially dividing the flap 50 into two parts. In this way the flap 50 can fold internally of the carton 90; the flap 50 can fold about the articles B (not shown in FIG. 7) disposed in the carton 90. The flap 50 may fold about one or more of the third, fourth, fifth and sixth fold lines 52, 53, 55, 56 in response to making contact with one or more articles B disposed in the carton 90.

The cushioning flaps 34, 36, 38 can be displaced out of the plane of the second handle reinforcing panel 32 as a consequence of the internal displacement of the flap 50.

The cushioning flap 38 may act as a mandrel or guide about which the flap 50 may fold.

The cushioning flap 38 may facilitate or guide folding of the flap 50 about the second fold line 57. The cushioning flap 38 may be dimensioned such that a free edge of the cushioning flap 38, (the free edge which opposes a hinged edge defined by the fold line 39), is arranged to be in registry or aligned with the second fold line 57.

Figure 5:
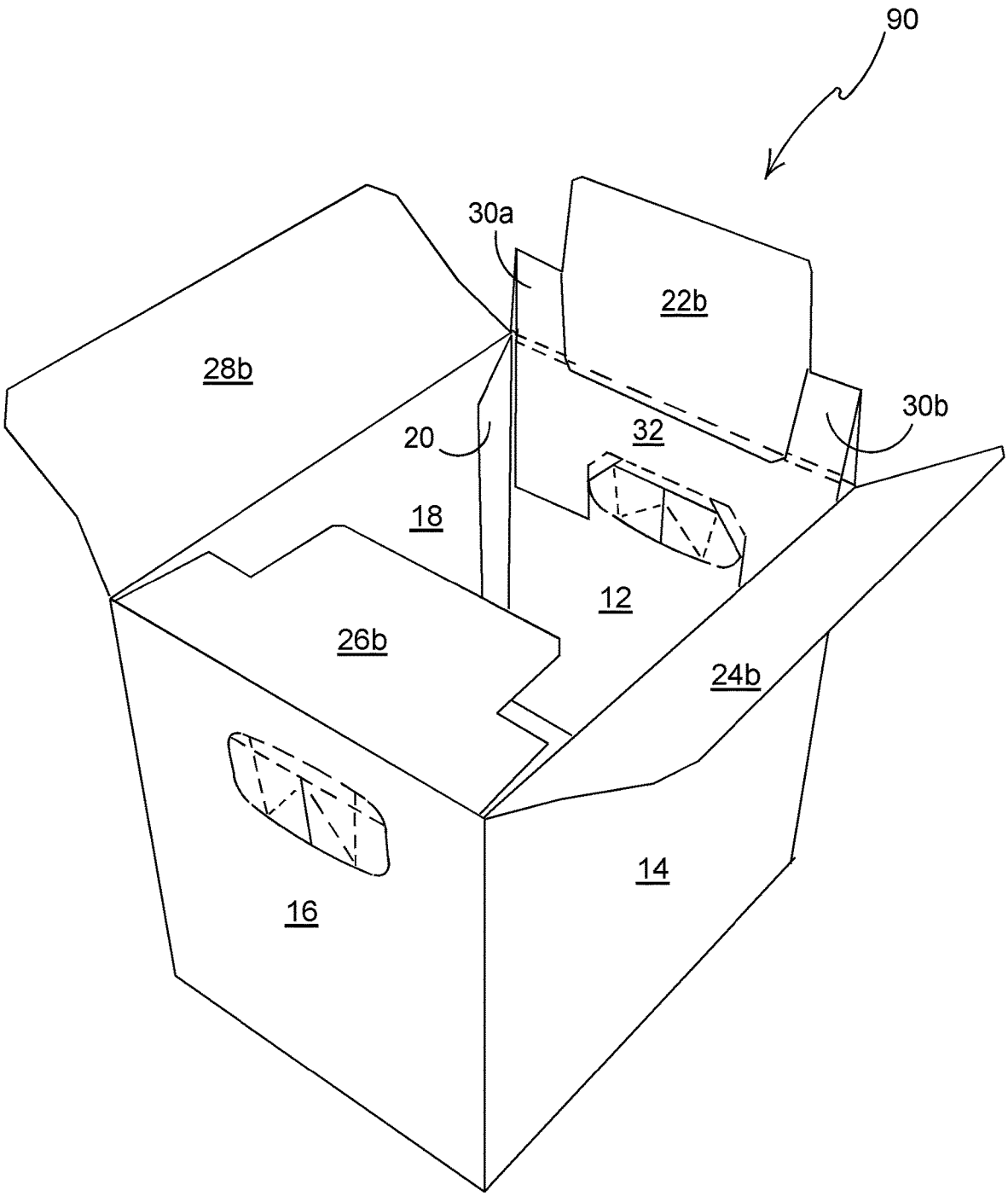

The first handle reinforcing panel 32 provides a second ply of material in the region immediately around the handle structure H, both above the handle structure H and either side thereof (as shown in FIG. 5). The second handle reinforcing panel 32 is hinged to the fifth end closure panel 22*b* indirectly (via first pair of connecting panels 30*a*, 30*b*) by fold lines 33*a*, 33*b*. Fold lines 33*a*, 33*b* are offset from the fold line 23*b*. The fold lines 33*a*, 33*b* are spaced apart from fold line 23*b*. The fold lines 33*a*, 33*b* are inset into the fifth end closure panel 22*b*. In this way the fold line 23*b* is uninterrupted; this may provide a more aesthetically desirable appearance. In this way, the majority of the fifth end closure flap 22*b* serves as a dust flap reducing the likelihood of ingress of dirt or dust into the carton 90.

The connecting panels 30*a*, 30*b* of the first handle reinforcing structure R1 are struck from material which would otherwise form the fifth end closure panel 22*b*. The first handle reinforcing panel 32 is sized similarly to an upper portion of the first side panel 12 to provide a greater area for being secured to first side panel 12 for reinforcing the handle structure H; and upper region of the first side panel 12 which will be subject to a significant load when the carton 90 is carried; and at the same time sufficient material of the fifth end closure panel 22*b* remains for securing the sixth and eighth end closure panels 24*b*, 28 thereto Accordingly, a carton 90 for packaging one or more articles B has been formed. The carton comprises a first panel 12 and a second panel 22*b* hingedly connected by a first hinged connection 23*b* to the first panel 12. The first panel 12 comprises a handle structure H. The handle structure H comprises a severance line 60 defining at least in part a handle opening. The second panel 22*b* has a handle reinforcing panel 32 hingedly connected thereto by two further hinged connections (33*a*, 33*b*). The two further hinged connections (33*a*, 33*b*) are spaced from the first hinged connection. The two further hinged connections (33*a*, 33*b*) are spaced from the one another and are formed in the second panel 22*b*. In this way, the handle reinforcing panel 32 reinforces a region of the first panel 12 and beneficially a carton 90 with a strong and robust carrying arrangement is provided. The carton 90 is formed from as economical amount of material as possible, yet due to the substantial reinforcement and 2-ply region above and either side of the handle structures H, a strong and robust carrying arrangement is provided. It can be appreciated that various changes may be made within the scope of the present invention. For example, the size and shape of the panels and apertures may be adjusted to accommodate articles of differing size or shape.

Whilst the foregoing embodiments have been described with reference to a fully enclosed carton it is envisaged that the reinforced handle structure may be employed in cartons of alternative design such as, but not limited to, wraparound style cartons, basket carriers and top gripping clips.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed, it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed, a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The invention claimed is:

1. A carton for packaging one or more articles, the carton comprising:

a first panel; and a second panel hingedly connected by a first hinged connection to the first panel;

the first panel comprising a handle structure, the handle structure comprising a severance line defining at least in part a handle opening;

the second panel having a handle reinforcing panel hingedly connected to the second panel by two further hinged connections;

wherein the two further hinged connections are spaced from the first hinged connection.

2. A carton according to claim 1, wherein the handle reinforcing panel comprises a cutaway shaped in a complementary manner to at least a portion of the handle opening and the remainder of the handle reinforcing panel is shaped similarly to an upper portion of the first panel to reinforce an area of the first panel on either side of and above the handle structure in the first panel.

3. A carton according to claim 1 or 2, wherein the two further hinged connections are parallel to the first hinged connection and are spaced apart from each other in a direction substantially parallel to the first hinged connection.

4. A carton according to claim 1, wherein the two further hinged connections each extend into the second panel by a distance of between 10% and 20% of a maximum width of that second panel such that the two hinged connections are spaced apart from each other and from the first hinged connection.

5. A carton according to claim 1, wherein the second panel forms a minor end closure panel.

6. A carton according to claim 1 wherein the handle structure comprises a handle flap defining at least in part the handle opening.

7. A carton according to claim 6 wherein the handle reinforcing panel comprises a cushioning flap arrangement which co-operates with said handle flap.

8. A carton according to claim 1, wherein the handle reinforcing panel is hingedly connected to the second panel via a pair of connecting panels.

9. A carton according to claim 8 wherein, the pair of connecting panels are not secured to the second panel and the handle reinforcing panel is secured to the first panel.

10. A carton according to claim 8 wherein the connecting panels of said pair of connecting panels are each formed from material that would otherwise form part of the second panel and wherein the connecting panels are hingedly connected to the second panel by said two further hinged connections.

11. A carton according to claim 1, wherein the first panel forms a side wall panel or wherein the first panel forms an end wall panel.

12. A blank for forming a carton, the blank comprising:

a first panel;

a second panel hingedly connected by a first hinged connection to the first panel;

the first panel comprising a handle structure, the handle structure comprising a severance line defining at least in part a handle opening; and a handle reinforcing panel hingedly connected to the second panel by a first pair of connecting panels which first pair of connecting panels is hingedly connected to the second panel by two further hinged connections, wherein the two further hinged connections are spaced from the first hinged connection.

13. A blank according to claim 12 wherein the handle reinforcing panel comprises a cutaway shaped in a complementary manner to at least a portion of the handle opening and the remainder of the handle reinforcing panel is shaped similarly to an upper portion of the first panel for providing a reinforcement of an area of the first panel either side of and above the handle structure in the first panel.

14. A blank according to claim 13, wherein the two further hinged connections are spaced apart from the first hinged connection; are parallel to the first hinged connection; and are spaced apart from one another.

15. A carton for packaging one or more articles, the carton comprising:

a plurality of panels for forming a tubular structure, the plurality of panels comprising:

a first side wall panel;

a first end wall panel;

a second side wall panel; and a second end wall panel, a first handle structure defined in a first one of the plurality of panels, the first handle structure comprising a severance line defining at least in part a handle opening;

a first end closure panel forming, at least in part, a top wall which at least partially closes an upper end of the tubular structure and is hingedly connected to the first one of the plurality of panels by a first hinged connection;

a first handle reinforcing panel hingedly connected to the first end closure panel by a pair of connecting panels hinged to the first end closure panel by two further hinged connections;

wherein the two further hinged connections are spaced from the first hinged connection.

16. A carton according to claim 15, wherein the handle reinforcing panel comprises a cutaway shaped in a complementary manner to at least a portion of the handle opening and the remainder of the handle reinforcing panel is shaped similarly to an upper portion of the first one of the plurality of panels to reinforce an area of the first one of the plurality of panels either side of and above the handle structure in the first panel.

* * * * *